United States Patent [19]

Izumi

[11] Patent Number: 4,511,456

[45] Date of Patent: Apr. 16, 1985

[54] PROCESS FOR CONTINUOUS PRODUCTION OF OPTICALLY ANISOTROPIC PITCH

[75] Inventor: Takayuki Izumi, Iruma, Japan

[73] Assignee: Toa Nenryo Kogyo Kabushiki Kaisha, Tokyo, Japan

[21] Appl. No.: 467,617

[22] Filed: Feb. 17, 1983

[30] Foreign Application Priority Data

Mar. 31, 1982 [JP] Japan ..... 57-52731

[51] Int. Cl.[3] ..... C10C 1/00

[52] U.S. Cl. ..... 208/44; 208/39; 423/447.4

[58] Field of Search ..... 208/44; 423/447.2, 447.4, 423/447.6

[56] References Cited

U.S. PATENT DOCUMENTS

| | | | |
|---|---|---|---|
| 3,976,729 | 8/1976 | Lewis et al. | 423/447.8 |
| 4,032,430 | 6/1977 | Lewis | 208/39 |
| 4,303,631 | 12/1981 | Lewis et al. | 423/447.4 |

*Primary Examiner*—Delbert E. Gantz
*Assistant Examiner*—Helane Myers
*Attorney, Agent, or Firm*—Joseph J. Dvorak

[57] ABSTRACT

A continuous process for producing an optically anisotropic pitch. A reaction tank is used to treat a starting material. An upper section is utilized for thermal decomposition polycondensation zone. A lower portion of the tank is used as a settling zone.

4 Claims, 3 Drawing Figures

PROCESS FOR CONTINUOUS PRODUCTION OF OPTICALLY ANISOTROPIC PITCH

FIELD OF THE INVENTION

The present invention relates to a process for producing a material suitable for the production of carbon fibers and molding carbon materials, and more particularly, to a process for continuous production of an optically anisotropic pitch for manufacturing carbon fibers and molding carbon materials having a high strength, high modulus of elasticity and high performance.

BACKGROUND OF THE INVENTION

Recently, high-performance carbon fibers having a high strength and a high modulus of elasticity or molding carbon materials having a high strength and a high modulus of elasticity usable for various purposes by molding under pressure have been demanded eagerly as starting materials for the production of light-weight composite materials having a high strength and a high modulus of elasticity desirable from the viewpoint of saving energy or resources as techniques in aircraft industry, motorcar industry and various other technical fields have progressed.

A process for producing these high-performance carbon materials at low costs by using an optically anisotropic pitch was first disclosed in U.S. Pat. No. 4,005,183. Thereafter, many production processes have been proposed (for example, Japanese Patent Laid-Open Nos. 89635/1975, 118028/1975, 49125/1978 and 55625/1979 and Japanese Patent Publication No. 7533/1978).

However, it has been difficult to produce a homogeneous, optically anisotropic pitch having a low softening point which can be spun stably without using any catalyst on an industrial scale, since these processes have the following defects: (1) the starting material is difficultly available on the market. (2) a long reaction time is required or complicated steps are required, (3) the production cost is high, (4) the softening point of the pitch is raised to make the spinning difficult, and (5) if the softening point of the pitch is controlled, the pitch becomes heterogeneous and, consequently, the spinning becomes difficult. In Japanese Patent Application No. 99646/1980, there is disclosed a process for producing a homogeneous, optically anisotropic pitch having a low softening point on an industrial scale without using any catalyst by overcoming the defects of the conventional techniques. This process for producing an optically anisotropic pitch is characterized in that a heavy oil, tar or pitch mainly comprising heavy hydrocarbons is used as starting material, the starting material is treated at a temperature of above about 380° C. to effect thermal decomposition and polycondensation, the amount of the optically anisotropic phase in the residual pitch is controlled to about 20–80% (percentages of the optically anisotropic pitch herein are given by volume), the polycondensate is stood at a temperature of up to 400° C. to precipitate the optically anisotropic high-density pitch of to form a lower layer in the reaction tank, the pitch is deposited as a growing and aging continuous phase, and the pitch is separated from a part containing a large amount of an optically anisotropic pitch in the upper layer in the reaction tank.

The inventors have noted that the "settling" in the invention of said Japanese Patent Application No. 99646/1980 is not necessarily a completely still state of the reaction mixture but satisfactory results may be obtained if the mixture is not stirred vigorously. After investigations, the inventors have found that the optically anisotropic pitch can be produced not batchwise but continuously on an industrial scale. The present invention has been attained on the basis of this finding.

SUMMARY OF THE INVENTION

The first object of the present invention is to provide a process for continuous production of an optically anisotropic pitch used for the stable production of a carbonaceous pitch having a high optically anisotropic phase content suitable for the stable production of high performance carbon materials (the term "optically anisotropic pitch" herein include the carbonaceous pitch of high content of optically anisotropic phase and a pitch of 100% optically anisotropic phase). The second object of the invention is to provide a process for continuous production of an optically anisotropic pitch used for the production of an optically anisotropic pitch of a low softening point at a low cost. The third object of the invention is to provide a process for continuous production of an optically anisotropic pitch feedback control of which is easy and quality of which can be stabilized easily.

The present invention provides a process for continuous production of an optically anisotropic pitch characterized by using an upper part in a reaction tank as a reaction zone stirred and heated to at least 380° C. for forming and increasing an optically anisotropic phase by thermal decomposition/polycondensation of a starting material for the production of an optically anisotropic pitch and a lower part in a reaction tank as a substantially non-stirred settling zone maintained at a temperature of below about 400° C. for separating and depositing the optically anisotropic pitch formed and increased in the reaction zone, continuously feeding the starting material for the production of the optically anisotropic pitch in the reaction zone in the upper part of the reaction tank, depositing the optically anisotropic pitch formed and increased in the reaction zone at the bottom of the settling zone and continuously taking the optically anisotropic pitch through the bottom of the reaction tank.

The upper part in the reaction tank according to the present invention is used as a reaction zone for the thermal decomposition and polycondensation of the starting material for the production of an optically anisotropic pitch and for forming and increasing the amount of the optically anisotropic pitch. The lower part of the reaction tank is used as a substantially non-stirred settling zone having a function of precipitation/aging reaction tank for separating and precipitating the formed optically anisotropic pitch. The boundary between the reaction zone and the standing zone is not necessarily clear. In some cases, the boundary may be a wide intermediate zone.

The reaction tank of the invention is vertical, since the upper and lower parts thereof have functions different from each other.

The upper part in the reaction tank should be stirred by any method for carrying out the thermal decomposition/polycondensation reaction uniformly and efficiently. It is preferred to employ stirring blades which rotate along the circumference so as to prevent coke deposition on the inner wall of the reaction tank. Excessive, violent stirring is not allowed, since influence of the stirring on the lower part in the reaction tank having a function of precipitation/aging reaction tank should be minimized. When ordinary propeller-type stirring blades are used, the tip speed of the propeller blades should be controlled below 30 cm/sec, because if it is stirred violently, globular particles of the optically anisotropic pitch formed as above are divided into quite fine particles to retard the subsequent aggregation and precipitation.

The lower part in the reaction tank is not stirred or stirred only slightly for accelerating the aging reaction including precipitation and aggregation of the optically anisotropic pitch formed as above. This part is referred to as the settling zone.

The substantially non-stirred settling zone herein means a zone in which a vertical flow which inhibits the precipitation of the optically anisotropic pitch formed and increased in the reaction zone is only slight.

Even in the settling zone, slow stirring with a vertical stirring plate so that the liquid flows along the circumference at a rate of up to 1 cm/sec is rather preferred, since it exhibits an effect of accelerating the aggregation of the globular particles in the optically anisotropic phase precipitated in this zone without inhibiting the precipitation of the optically anisotropic pitch.

The reaction zone in the upper part in the reaction tank is stirred with stirring blades located at the center of the reaction zone. For protecting the settling zone from influence of the stirring, baffle(s) may be placed in an intermediate zone between the reaction zone and the settling zone or in a part or the whole of the settling zone. The baffles may be vertical plates arranged radially, honeycomb-shaped baffles or network-type baffles. In case the baffles are placed through the whole settling zone, the settling zone is partitioned into substantially vertical rooms by the baffles. When the baffles are placed in this manner, the boundary between the reaction zone and the settling zone is relatively clear and the width of the intermediate zone is reduced.

As the starting materials for the production of the optically anisotropic pitch used in the present invention, there may be used various so-called heavy hydrocarbons oils, tar and pitch. They include, for example, petroleum heavy oils, asphalts (such as straight asphalt and blown asphalt), thermally cracked tar, decanted oil, and heavy oils, tar and pitch obtained by the dry distillation of coal as well as heavy, liquefied coal obtained by the liquefaction of coal. If necessary, they are treated previously according to filtration or extraction with a solvent. A carbonaceous pitch partially comprising the optically anisotropic pitch obtained after some treatment may be used as the starting material particularly for stabilizing the quality of the optically anisotropic pitch obtained by the present invention.

DETAILED DESCRIPTION OF THE INVENTION

Figure 1:
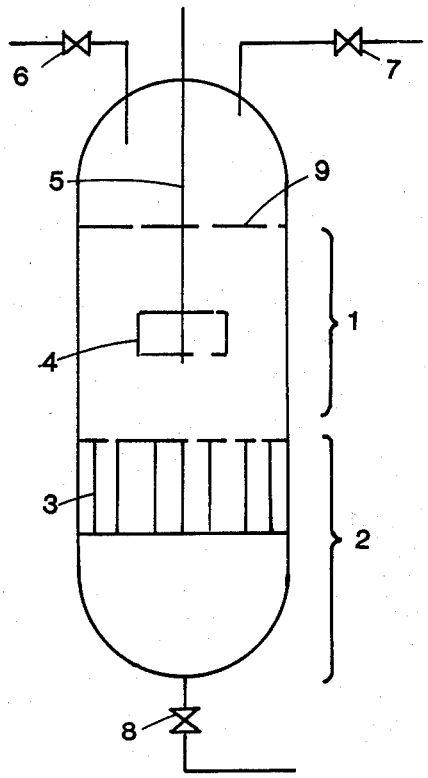
FIG. 1 shows an embodiment of the reaction tank of the present invention.
Figure 2:
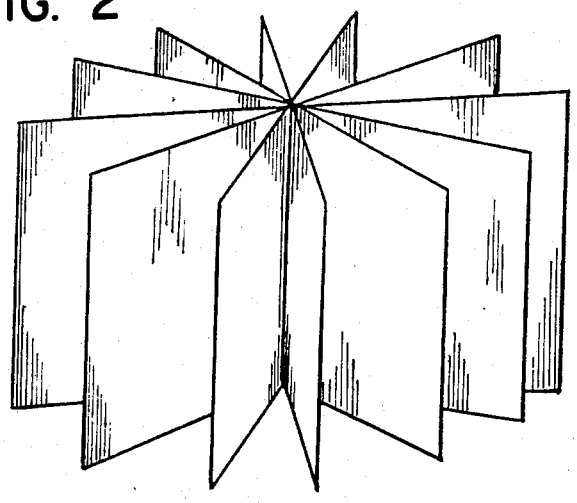
FIG. 2 shows a typical baffle used in the intermediate zone of the reaction tank of FIG. 1, having vertical plates arranged radially.

First, the starting material is fed continuously into the upper part of the reaction tank shown in FIG. 1 to effect the thermal decomposition/polycondensation reaction in the heated and stirred reaction zone. The term "thermal decomposition/polycondensation reaction" herein means that both thermal decomposition reaction and polycondensation reaction of the heavy hydrocarbons in the starting material occur as main reactions simultaneously to change the chemical structure of molecules of the pitch components. By this reaction, cleavage of the paraffin chain structure, dehydrogenation, ring closure and development of a plane structure of polycyclic condensed aromatic compounds due to the polycondensation proceed.

In FIG. 1, 1 is reaction zone, 2 is a settling zone, 3 is a baffle placed in a part of the settling zone, 4 is stirring blades arranged in the center of the reaction zone, 5 is a stirring shaft, 6 is a valve for introducing starting material, 7 is a valve for discharging decomposed oil, 8 is a valve for discharging optically anisotropic pitch, and 9 is liquid level of the reaction product.

For carrying out the above-mentioned reaction, the reaction zone should be heated to above about 380° C., preferably about 380°–430° C., particularly about 390°–410° C. If the temperature in the reaction zone is above 430° C., coking on the walls is accelerated and the deposit of the optically anisotropic pitch formed as above is reduced unfavorably, while at a temperature of below about 380° C., a long reaction time is required unfavorably.

The temperature in the reaction zone may be either uniform or non-uniform within the above-mentioned temperature range. It is preferred, however, that the temperature is gradually lowered from the upper part towards the lower part in the reaction zone for facilitating the precipitation of the formed optically anisotropic pitch. The temperature in the settling zone (i.e. precipitation/aging zone for the optically anisotropic pitch) in the lower part in the reaction tank is up to about 400° C., preferably about 300°–380° C., particularly about 360°–370° C. If the temperature in the lower part is higher than the upper part at a temperature gradient of higher than about 0.3° C./cm, the precipitation of the formed optically anisotropic pitch is inhibited by the thermal convection unfavorably. Therefore, for attaining rapid precipitation of the optically anisotropic pitch, it is preferred to gradually lower the temperature from the upper part to the lower part in the settling zone.

During the thermal decomposition/polycondensation reaction according to the present invention, the reaction mixture is stirred for preventing a local overheating and for effecting a uniform reaction. Further, this reaction may be carried out under reduced pressure for rapidly removing low-molecular substances formed by the thermal decomposition or, if necessary, with introduction of an inert gas into the reaction zone. As the inert gas, there may be used a gas having a sufficiently low reactivity with the pitch in the reaction temperature range according to the present invention, such as nitrogen, steam, carbon dioxide, light hydrocarbon gas or a mixture of them. It is preferred to preheat the inert gas before the introduction so as to prevent the lowering of the reaction temperature, or to give heat to the reaction zone.

The inert gas containing the decomposed oil gas is taken out through the top of the reaction tank. The gas is passed through a condenser, scrubber and separation tank to remove the decomposed oil gas. Thereafter, the inert gas may be used again by recycling.

In the present invention, the starting material introducing rate is controlled so as to compensate the optically anisotropic pitch discharged through the bottom of the tank and the distillation amount of the decomposed oil by calculating a necessary residence time in the reaction zone depending on properties of the starting material such as an optically anisotropic pitch content. The control may be effected easily by, for example, measuring the liquid level in the reaction tank and adjusting the same.

A finishing tank may be provided after the reaction tank to effect further heat treatment and to obtain a heavier product for controlling the softening point of the pitch discharged through the bottom of the reaction tank and for controlling an optically anisotropic pitch content thereof.

As described above, according to the process of the present invention for producing optically anisotropic pitch, the reaction can be carried out in only one vessel, since the pitch is produced completely continuously unlike batch process or semi-continuous process. By employing feedback control capable of controlling the quality of the optically anisotropic pitch by controlling the rate of introduction of the starting material and the rate of discharging the intended pitch, the operation can be effected stably for a long time. Therefore, the process of the invention is a quite effective process for the production of an optically anisotropic pitch on an industrial scale.

Figure 3:
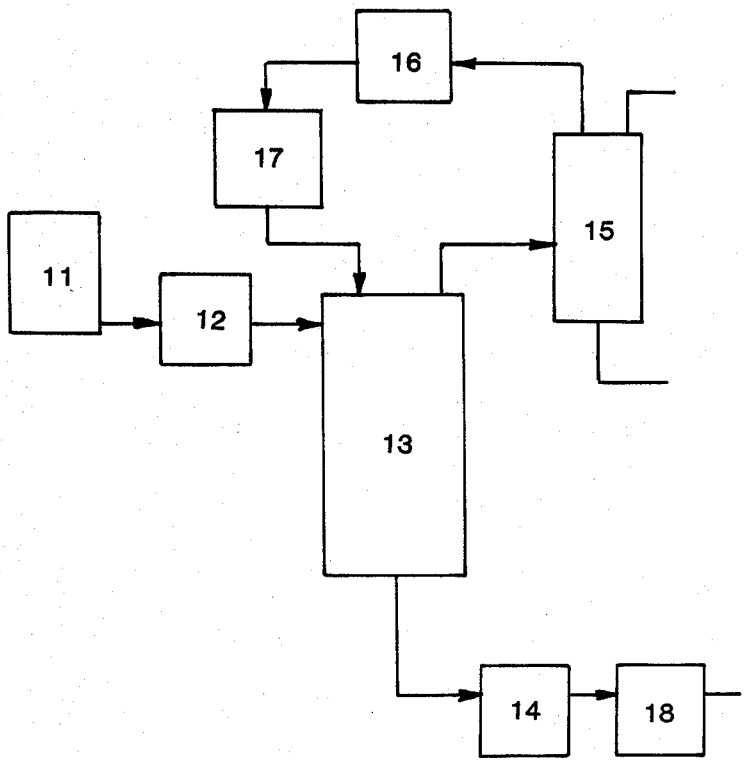
FIG. 3 is a flow sheet showing the continuous production of an optically anisotropic pitch from a starting pitch according to the process of the present invention.

In FIG. 3, 11 is a starting pitch tank, 12 is a preheater for the starting material, 13 is a reaction tank having a reaction zone and a settling zone, 14 is a finishing tank for controlling the optically anisotropic phase content and softening point of the optically anisotropic pitch discharged, 15 is a decomposed oil separater, 16 is a compressor for introducing inert gas into the reaction tank, 17 is preheater for inert gas and 18 is a flaker.

As shown in FIG. 3, various devices may be connected with the reaction tank to simplify transportation lines for the starting material and semi-finished product, to improve the operating characteristics and to omit the operations of, for example, changeover of numerous reaction tanks, charging of the starting material and discharge, whereby the costs are reduced remarkably.

The following example will further illustrate the present invention, which by no means limit the invention.

EXAMPLE 20 kg of a starting pitch having a softening point of 169° C. and an optically anisotropic phase content of about 25 vol. % was charged in an about 30-1 cylindrical stainless steel reaction tank having a height of about 80 cm. Then, a liquid temperature in an upper $\frac{3}{4}$ portion in the reaction tank was maintained at 395°–405° C. with a mantle heater placed on the outer wall. Propeller-type stirring blades having a diameter of 10 cm were inserted in the center of the reactor and the pitch was stirred at 100 r.p.m. The liquid temperature in a lower $\frac{1}{4}$ portion in the reaction tank was maintained at 350°–360° C. with a mantle heater placed on the outer wall. A baffle comprising 12 stainless steel plates of 5 cm length arranged vertically and radially was arranged in the lower part of the reaction tank, the top of the baffle being located about 20 cm distant from the bottom. After heating the reaction tank to a given temperature, about 20 l/min of nitrogen gas heated to about 350° C. was introduced through the top of the reaction tank and through an introducing tube. An oil vapor formed by the decomposition was taken out through the top and recovered by means of a condenser and a trap. The intended pitch was taken out at a rate of about 80–90 ml/min through a pitch-discharging tube arranged at the bottom of the reaction tank, while the preheated starting pitch was introduced at a flow rate of 80–110 ml/min through a starting pitch-introducing tube connected with the top of the tank while monitoring the liquid phase level. This state was kept for about 7 h. The pitch discharged had stationary properties. Thus, an optically anisotropic pitch having an optically anisotropic phase content of about 92–96% and a softening point of 266°–268° C. could be produced over a long time.

What is claimed is:

1. A process for continuous production of an optically anisotropic pitch, consisting essentially of the steps of:

(a) providing a reaction tank having an upper reaction zone and a lower settling zone;

(b) continuously feeding a starting material capable of forming an optically anisotropic pitch at elevated temperatures to said reaction zone;

(c) continuously stirring and heating said starting material fed to said reaction zone to at least about 380° C. for forming and increasing an optically anisotropic component of said starting material by thermal decomposition/polycondensation reactions;

(d) continuously passing said heated starting material to said settling zone while maintaining the material passed to said settling zone at a temperature below about 400° C.;

(e) interposing a baffle between the reaction zone and said settling zone thereby preventing said material in said settling zone from being influenced by the stirring of said starting material in said reaction zone; and (f) continuously removing from the bottom portion of said settling zone an optically anisotropic pitch component produced from said starting material.

2. The process for continuous production of an optically anisotropic pitch of claim 1, wherein said thermal decomposition/polycondensation reaction in said reaction zone is accomplished in an inert gas atmosphere.

3. The process for continuous production of an optically anisotropic pitch of claim 1 wherein said heating is accomplished in a range of 380° C. to 430° C., in said reaction zone.

4. The process for continuous production of an optically anisotropic pitch of claim 1 wherein said maintenance of said optically anisotropic component is accomplished in a temperature in the range of 330° C. to 380° C., in said settling zone.

* * * * *